US006045424A

United States Patent [19]

Chang et al.

[11] Patent Number: 6,045,424

[45] Date of Patent: Apr. 4, 2000

[54] SPARK PLUG TIP HAVING PLATINUM BASED ALLOYS

[75] Inventors: Chin-Fong Chang, Morris Plains, N.J.; Richard Dale Taylor; Lee Randall Franz, both of Findlay, Ohio; Edgar Arnold Leone, Randolph, N.J.

[73] Assignee: AlliedSignal Inc., Morristown, N.J.

[21] Appl. No.: 09/114,425

[22] Filed: Jul. 13, 1998

[51] Int. Cl.[7] ..... H01T 21/02

[52] U.S. Cl. ..... 445/7; 313/118; 313/141

[58] Field of Search ..... 445/7; 313/141, 313/142, 144, 118

[56] References Cited

U.S. PATENT DOCUMENTS

| | | | |
|---|---|---|---|
| 4,810,220 | 3/1989 | Moore . | |
| 4,840,594 | 6/1989 | Moore . | |
| 4,904,216 | 2/1990 | Kagawa et al. | 445/7 |
| 5,273,474 | 12/1993 | Oshima et al. . | |
| 5,395,273 | 3/1995 | Matsutani . | |
| 5,440,198 | 8/1995 | Oshima et al. . | |
| 5,456,624 | 10/1995 | Moore et al. . | |
| 5,461,210 | 10/1995 | Matsutani et al. . | |
| 5,461,275 | 10/1995 | Oshima . | |
| 5,461,276 | 10/1995 | Matsutani et al. . | |
| 5,478,265 | 12/1995 | Matsutani et al. . | |
| 5,488,262 | 1/1996 | Takamura . | |
| 5,497,045 | 3/1996 | Matsutani et al. . | |
| 5,556,315 | 9/1996 | Kagawa . | |
| 5,574,329 | 11/1996 | Kagawa . | |
| 5,578,894 | 11/1996 | Oshima . | |
| 5,578,895 | 11/1996 | Oshima . | |
| 5,736,809 | 4/1998 | Matsutani et al. | 445/7 |

*Primary Examiner*—Kenneth J. Ramsey

[57] ABSTRACT

A spark plug and method of making same, wherein the spark plug includes a platinum alloy tip portion which takes the form of a rivet or a sphere. The tip portion is annealed in an annealing furnace at a temperature between about 700°–1400° C. for a time between about 5–30 minutes. The annealed tip portion is then resistance welded to an electrode of the spark plug. The annealing provides the tip portion with added resistance to corrosion and attack by lead. Preferred embodiments of the spark plug tip material comprise 80% platinum—20% rhodium; 80% platinum—20% iridium; 96% platinum—4% tungsten; and Pt (bal)-Ir(a)%-W(b)%, where "a" ranges from about 15 to 19 percent by weight, "b" ranges from about 1 to 4 percent by weight, and the balance is comprised of platinum and incident impurities, and wherein the sum of iridium and tungsten present ranges from about 16 to 19.

9 Claims, 7 Drawing Sheets

50 μm

SPARK PLUG TIP HAVING PLATINUM BASED ALLOYS

BACKGROUND OF THE INVENTION

1. Technical Field

This invention relates to spark plugs, and more particularly to a spark plug having a tip portion composed of platinum based alloys and annealed to provide high resistance to lead and other corrosive elements which could adversely affect the tip portion and therefore shorten the life of the spark plug.

2. Discussion

Spark plugs are used in internal combustion engines to ignite fuel in a combustion chamber. The electrodes of a spark plug are subject to intense heat and an extremely corrosive atmosphere generated by the formation of a spark and combustion of the air/fuel mixture. To improve durability and erosion resistance, the spark plug electrode tips must be able to withstand the high temperature and corrosive environment of the internal combustion chamber resulting from the chemical reaction products between air, fuel and fuel additives.

SAEJ312 describes the specification for automotive gasoline used as a fuel in the United States. The gasoline consists of blends of hydrocarbons derived from petroleum: saturates (50–80%), olefins (0–15%), and aromatics (15–40%). Leaded gasoline contains about 0.10 g Pb/gallon fuel (0.026 g Pb/L), and 0.15% sulfur. In unleaded gasoline there is about 0.05 g Pb/gallon, (0.013 g Pb/L), 0.1% sulfur, 0.005 g P/gallon, (0.0013 g P/L). In addition, there are a number of additives incorporated into the fuel for various reasons. For example, tetramethyllead (TML) and tetraethyllead (TEL) are added as antiknock agents. Carboxylic acids (acetic acid), compounds are added as lead extenders. Aromatic amines, phenols are added as antioxidants. Organic bromine, chlorine compounds are added as scavengers and deposit modifiers. Phosphors and boron containing compounds are added to reduce surface ignition, preignition and as engine scavengers. Metal deactivators are added to reduce oxidative deterioration of the fuel by metals, such as Cu, Co, V, Mn, Fe, Cr and Pb. In addition, carboxylic acids, alcohols, amines, sulfonates, phosphoric acid salts of amines, are used as rust-preventing additives.

The mechanism for ignition in an internal combustion engine is very complex and is briefly discussed here. In the gasoline engine, the rising piston compresses the fuel/air mixture, causing increases in pressure and temperature. The spark ignites the fuel-air charge, and the force of the advancing flame front acts against the piston, compressing the unburned fuel-air charge further. Pre-flame combustion reactions occur in the unburned fuel-air mixture. The pinging noise or knock often associated with internal combustion engines is produced when an extremely rapid combustion reaction occurs in the end gas ahead of the advancing flame front. The formation of the preflame reaction products of the gasoline sets the stage for knock. It is believed that the alkyllead additive must first decompose in the combustion chamber to form lead oxide before it can exert its antiknock effect. The antiknock species must be finely dispersed in the combustion chamber so that adequate numbers of collisions of the critical reacting species with the antiknock agent will occur. However, lead oxide deposits can cause problems of valve burning and spark plug fouling. Lead deposits which accumulate on the spark plug insulator cause engine misfiring at high speed due to the relatively high electrical conductivity of the deposit.

The complete combustion of a hydrocarbon fuel with air will produce carbon dioxide ($CO_2$), water ($H_2O$) and nitrogen ($N_2$). The ratio of air to fuel by weight, 14.5/1, is the chemically correct mixture ratio. When less air is available, some carbon monoxide (CO) and hydrogen ($H_2$) are found in the products, whereas if excessive air is available some oxygen ($O_2$) is found in the products. The atmosphere present during the combustion may cause the hot corrosion of electrodes in the spark plug.

The manufacture of copper (Cu) and nickel (Ni) electrodes for spark plugs is a proven art and has been accomplished in a variety of ways. For instance, U.S. Pat. No. 3,803,892 issued Apr. 16, 1974 and entitled "Method of Producing Spark Plug Center Electrode" describes a method of extruding copper and nickel electrodes from a flat plate of the two materials. U.S. Pat. No. 3,548,472 issued Dec. 22, 1970 and entitled "Ignition Plug and Method for Manufacturing a Center Electrode for the Same" illustrates a method of cold forming an outer nickel cup shaped sleeve by several steps, inserting a piece of copper wire into the cup and then lightly pressing the two materials together. U.S. Pat. No. 3,857,145 issued Dec. 31, 1974 and entitled "Method of Producing Spark Plug Center Electrode" discloses a process whereby a copper center core is inserted into a nickel member and attached thereto by a collar portion to assure that an electrical flow path is produced.

The spark plug electrodes produced by the methods disclosed above perform in a satisfactory manner for a relatively short period of driving time when used in vehicles that were manufactured prior to the implementation of the clean air act of 1977 in the United States. After 1977, with modifications to engine and fuel, the operating temperature of most vehicle increased. As a result of the changes in the engines and fuels, some of the operating components in engines have been subjected to the corrosive effects of the exhaust gases. After a period of time of operating at higher temperatures in recirculation gases, some corrosion/erosion can occur at the nickel-based center electrode. Once corrosion has taken place, the electrical flow path deteriorates which can result in lower fuel efficiency.

Presently manufactured spark plugs for automotive vehicles typically include an electrode which is manufactured at least in part from nickel. The electrode also typically includes a very small tip portion which is welded to the electrode during manufacture of the spark plug. The tip portion is typically in the shape of a sphere or a rivet and is comprised typically of a platinum alloy, and frequently of platinum and nickel.

The problem with such spark plugs having platinum-nickel tip portions is that the platinum is susceptible to attack by lead and the nickel to selective oxidation at high temperatures. Current methods of manufacturing such electrodes involve cold forming to form the spheres or rivets, and the cold forming process also serves to reduce the resistance of the tip to erosion. Presently, there is a need and desire to develop a long life (up to 150,000 miles) spark plug for internal combustion engines which is suitable for use with both leaded and unleaded fuels. There is further a need for such a long life spark plug which can be manufactured by present day manufacturing procedures, which is not appreciably more expensive than presently manufactured spark plugs, and which includes an electrode which is manufactured so as to be highly resistant to attack by lead and other corrosive elements at high operating temperatures. There is further a need for a long life spark plug which can be manufactured without significantly increasing the complexity of the assembly process used in manufacturing the spark plug.

SUMMARY OF THE INVENTION

The present invention relates to a long-life spark plug and a method of manufacturing same. The spark plug comprises at least one electrode, and preferably a pair of electrodes, each of which include a tip portion welded thereto. The tip portion comprises either a sphere or a rivet-shaped portion comprised of a platinum alloy. In a preferred embodiment, the tip portion is comprised of platinum, iridium and tungsten.

During manufacture, the tip portion is annealed in an annealing furnace at a temperature within a range of between about 900–1400° C. The annealing furnace is preferably charged with argon, nitrogen or subjected to a vacuum, and the tip portion is maintained in the furnace for a time period preferably within the range of about 5–15 minutes. This produces a tip portion having a fine grain microstructure.

Subsequently, the tip portion is allowed to cool down to, or nearly to, room temperature and then placed in a welding fixture. The tip portion is then aligned with the electrode and then resistance welded to the electrode. The same procedure is preferably performed on both the center and ground electrodes of the spark plug. The annealed tip portions have a high resistance to attack by lead and other corrosive elements typically experienced in the combustion chambers of internal combustion engines.

The resulting spark plug has an extremely long life (up to approximately 150,000 miles or more). The gap established between the two electrodes of the spark plug is further maintained substantially constant for the life of the spark plug since the tip portions at each of the electrodes are substantially unaffected by the gases produced in the combustion chambers of an internal combustion engine.

BRIEF DESCRIPTION OF THE DRAWINGS

The various advantages of the present invention will become apparent to one skilled in the art by reading the following specification and subjoined claims and by referencing the following drawings in which:

DETAILED DESCRIPTION OF THE PREFERRED EMBODIMENTS

Figure 1:
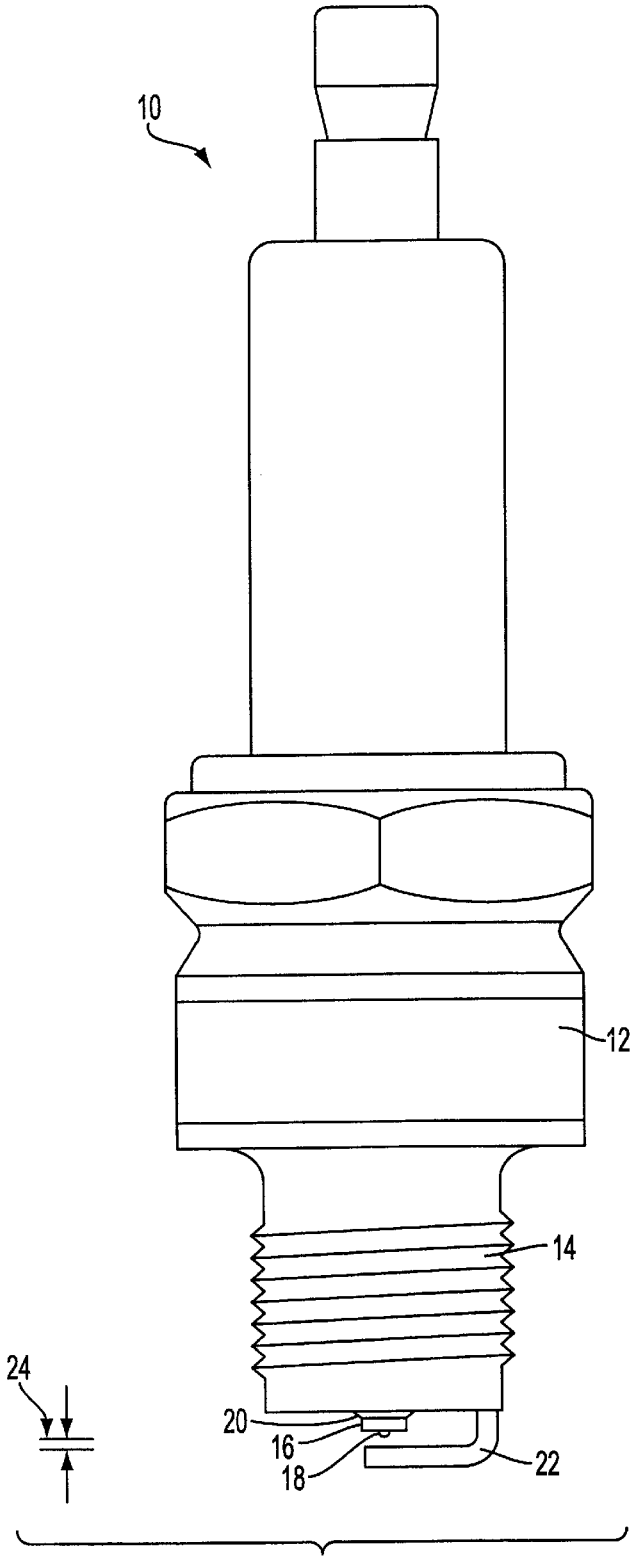
FIG. 1 is an elevational view of a portion of a spark plug in accordance with a preferred embodiment of the present invention incorporating an annealed tip portion at each of the center and ground electrodes thereof.

Referring to FIG. 1, there is illustrated a spark plug 10 in accordance with a preferred embodiment of the present invention. Spark plug 10 includes an annular metal housing 12 having threads 14 formed thereon, a center electrode 16 having a tip portion 18, an insulator 20 and a side or ground electrode 22. The center electrode 16 is disposed within the insulator 20, which is in turn disposed within the metal housing 12. As is well known, it is desirable to maintain the distance between the tip portion 18 and the side electrode 22, hereinafter referred to as the "gap" 24, constant over the life of the spark plug 10.

The tip portion 18 has heretofore been manufactured from platinum (Pt), which has been found to provide good resistance to spark erosion wear in the presence of combustive gases present in the combustion chambers of an internal combustion engine. Nevertheless, the platinum tip portion 18, which is shown in FIG. 1 in the shape of a sphere, is still susceptible to attack by lead, which is present in some fuels still being used with internal combustion engines. The erosion and deterioration of the tip portion can cause the gap 24 to widen, thus weakening the spark that the spark plug 10 produces.

It has been found that iridium (Ir) has excellent resistance to attack by a wide range of molten metals. Accordingly, the preferred embodiments of the tip portion 18 described herein are comprised preferably of 80% platinum—20% iridium, or 80% platinum—20% rhodium or 80% platinum—4% tungsten. Alternatively, the tip portion could be comprised of the following alloys:

Pt (about 81%)—Ir (about 18%)—W (about 1%);

Pt (about 81%)—Ir (about 15%)—W (about 4%); or

Pt (at least about 80)—Ir (less than about 20%) and W (less than about 4%).

It will also be appreciated that the amount of iridium, rhodium or tungsten can vary significantly, and that the percentages expressed above could be varied if desired.

Figure 2:
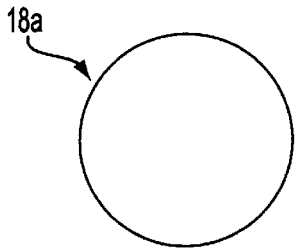
FIG. 2 is an elevational side view of a platinum alloy sphere before same is resistance welded to one of the electrodes of the spark plug.
Figure 3:
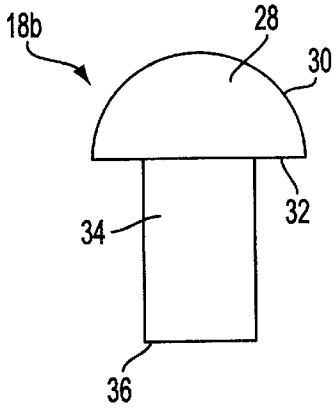
FIG. 3 is an elevational side view of a platinum alloy rivet in accordance with a preferred embodiment of the present invention before same is resistance welded to one of the electrodes of the spark plug.

Referring now to FIGS. 2 and 3, there are shown two embodiments of the tip portion 18 of the present invention. FIG. 2 illustrates the tip portion in the form of a sphere 18*a*. The diameter of the sphere may vary significantly but is preferably within the range of about 381 um–1.14 mm (0.015–0.045 inch), and more preferably about 0.760 um (0.030 inch).

FIG. 3 illustrates the tip portion 18 in the form of a rivet 18*b*. The rivet 18*b* includes a head 28 having a continuous, semi-spherical outer surface 30 and a flat portion 32. A shank 34 extends from the flat portion 32 and has a flat outer surface 36.

Figure 4:
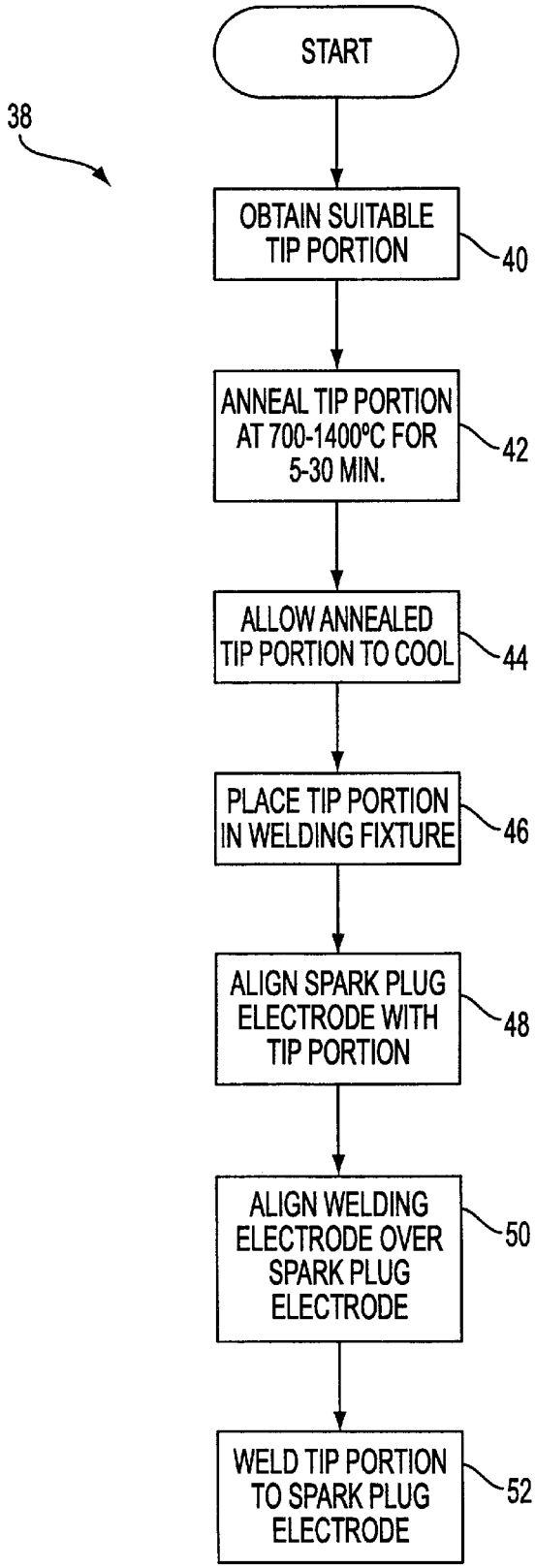
FIG. 4 is a flow chart of the steps used to heat treat and secure the tip portion to an electrode of the spark plug.

Referring now to FIG. 4, a flow chart 38 illustrates the steps performed in heat treating and welding the tip portion 18 to the electrode 16. Initially, a platinum-iridium, platinum-rhodium or platinum-tungsten tip portion is obtained, as indicated at step 40. The tip portion can be in the form of a sphere or rivet. The tip portions are commercially available from a number of companies such as Engelhard Corporation, Johnson Matthey and Sigmund Cohn Corporation.

With further reference to FIG. 4, a suitable tip portion 18 is first chosen, as indicated at step 40. The tip portion 18 is then annealed in an annealing furnace at a temperature preferably within the range of about 700°–1400° C. and for a time period preferably between about 5–30 minutes, and more preferably for a time between about 5–15 minutes, as indicated at step 42. After the annealing is completed, the annealed tip portion 18 is removed from the annealing furnace and allowed to cool to room temperature, as indicated at step 44.

Figure 6:
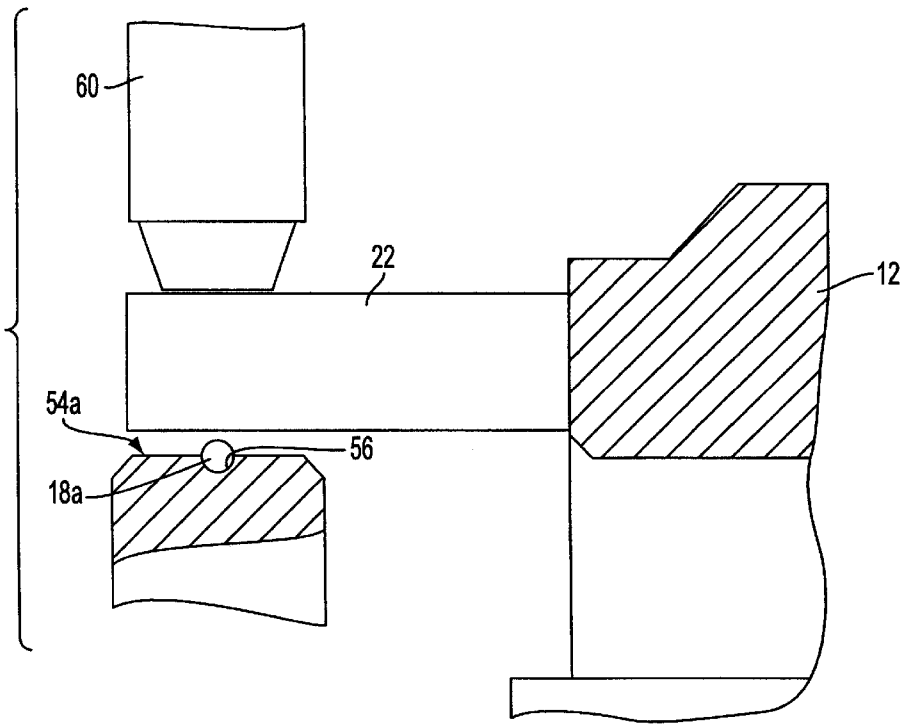
FIG. 6 is a simplified side view of a welding tool being used to resistance weld the tip portion to the side electrode of the spark plug, where the tip portion comprises a sphere-shaped tip portion.
Figure 5:
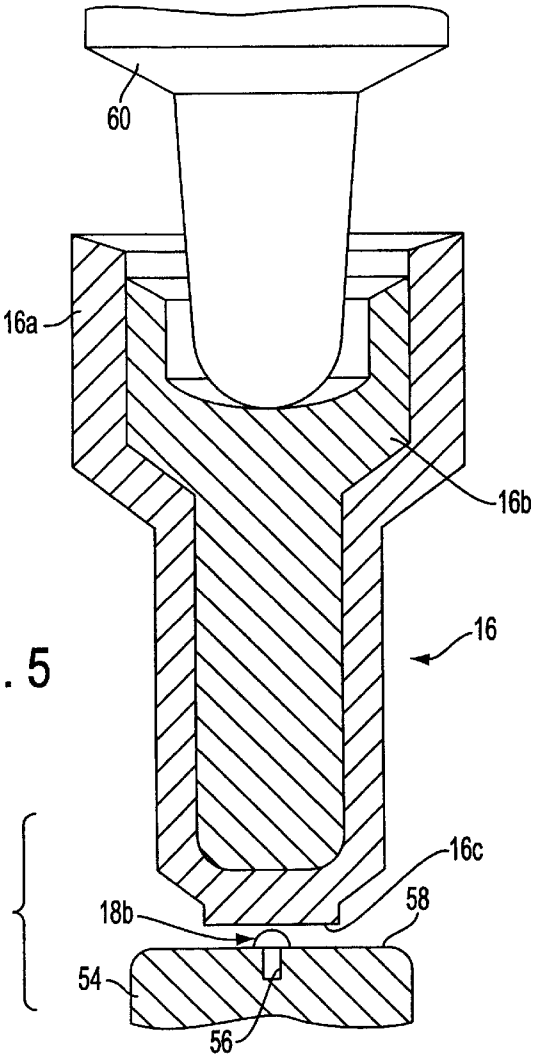
FIG. 5 is a simplified drawing of a welding tool being used to resistance weld the tip portion to the center electrode of the spark plug, where the tip portion comprises a rivet-shaped tip portion.

Referring now to FIGS. 4 and 5, the tip portion 18*b* is then placed in a welding fixture, as indicated at step 46. In FIG. 5, the welding fixture is designated by reference numeral 54 and has a recess 56. The recess 56 is shaped to hold either a sphere-shaped or a rivet-shaped tip portion on a flat upper surface 58. FIG. 6 illustrates a welding fixture 54*a* suitable for holding the sphere-shaped rivet 18 *a*. The electrode 16 can be seen to include an outer portion 16*a* made of nickel and a copper core 16*b*. A lower flat surface 16c is positioned to face the rivet-shaped tip portion 18*b*.

At step 48 in FIG. 4, the spark plug electrode 16 is aligned with the tip portion, as also illustrated in FIG. 5. A welding electrode 60 is then aligned over the spark plug electrode 16, as indicated at step 50 (and in FIG. 5) and the tip portion 18*b* is then resistance welded to the spark plug electrode as indicated at step 52. FIG. 6 illustrates steps 46–50 for the sphere-shaped tip portion 18*a* being attached to the ground electrode 16 of the spark plug 10.

Figure 7:
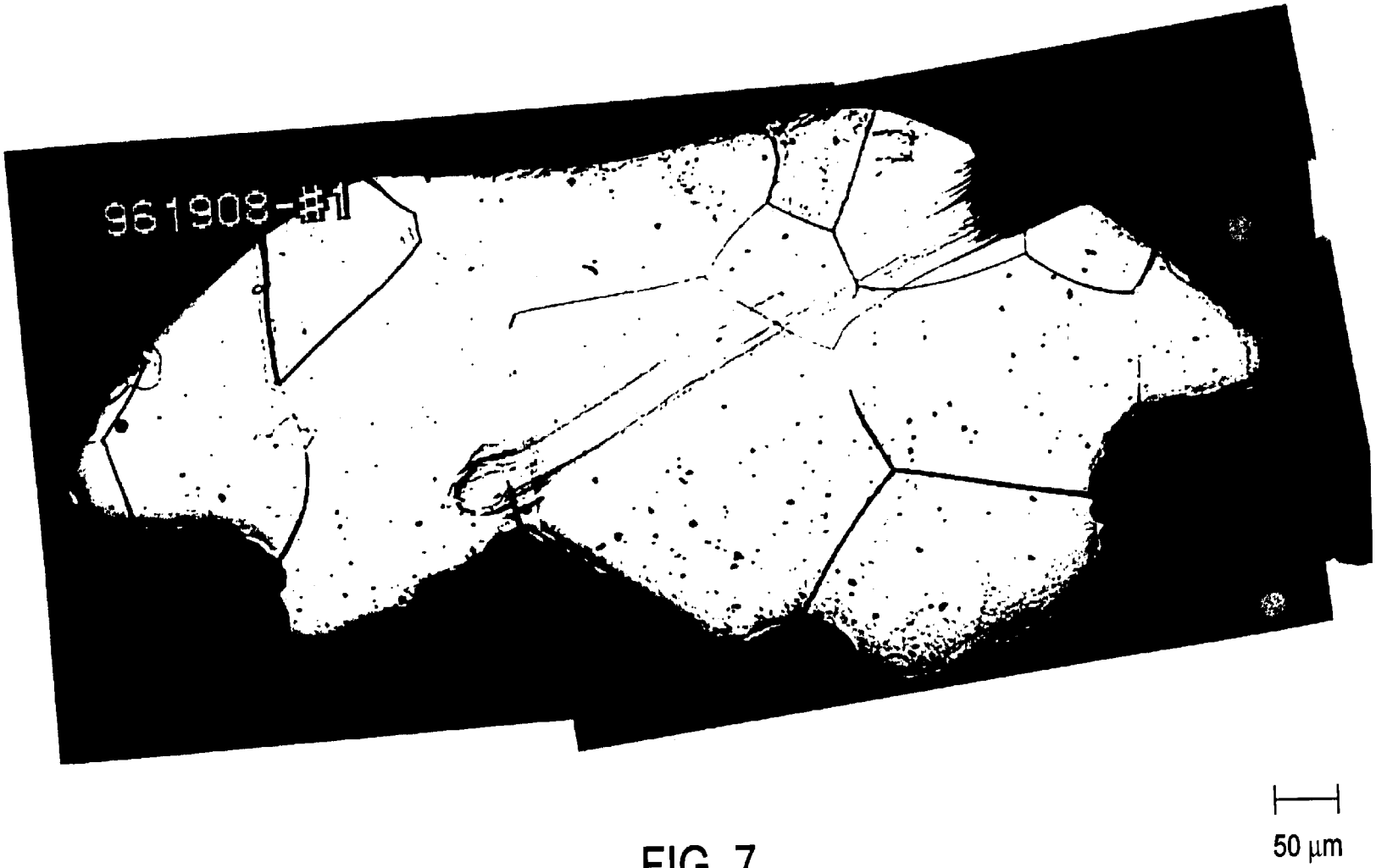
FIG. 7 is a micrograph of a coarse grained 80% Pt—20% Ir platinum based alloy spark plug tip portion after 75 hours exposure to leaded fuel during a SPEAD test.
Figure 9:
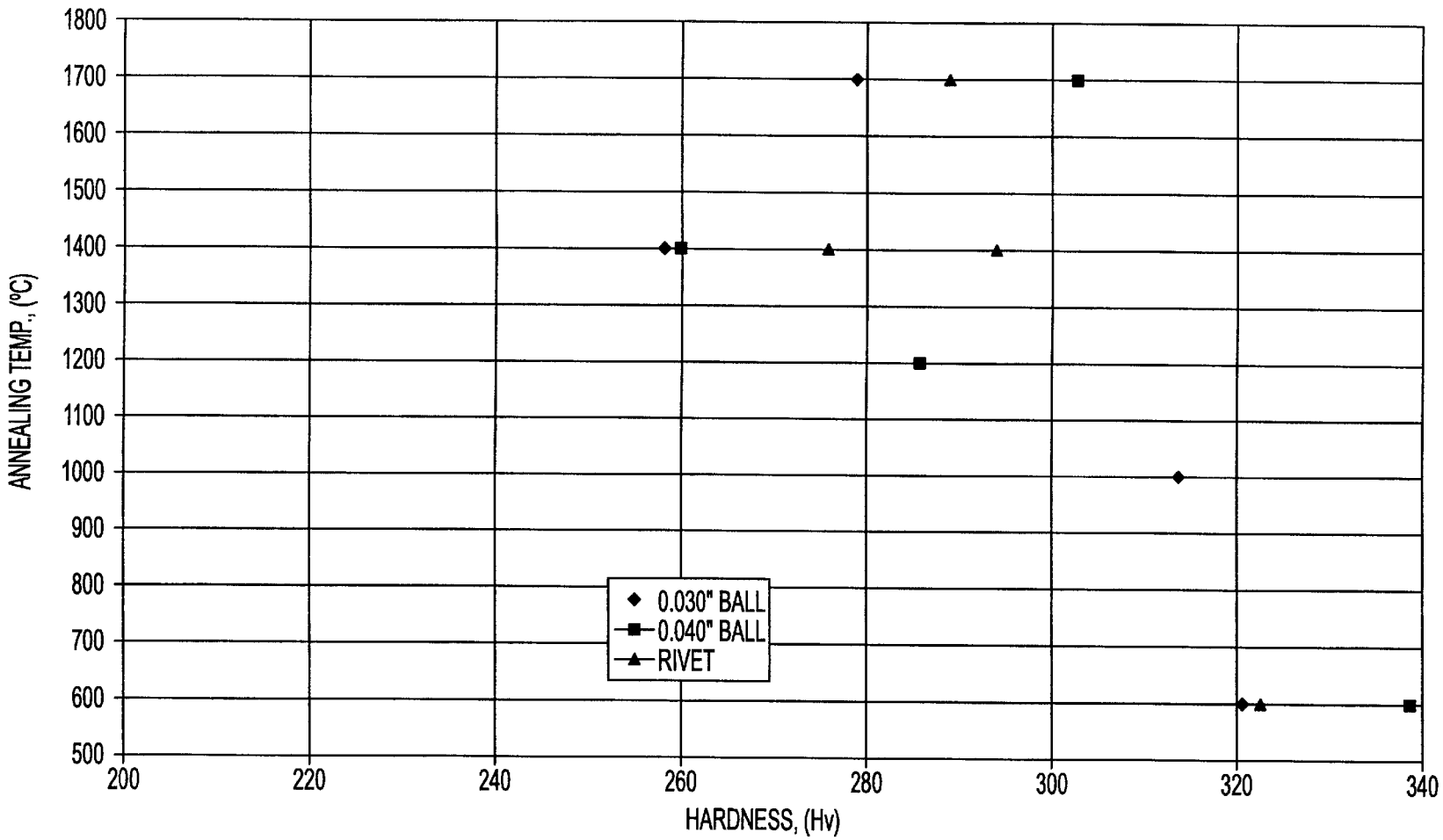
FIG. 9 is a graph indicating the hardness of an annealed 80% Pt—20% Ir alloy after being subjected to an annealing temperature for 5 minutes.
Figure 10:
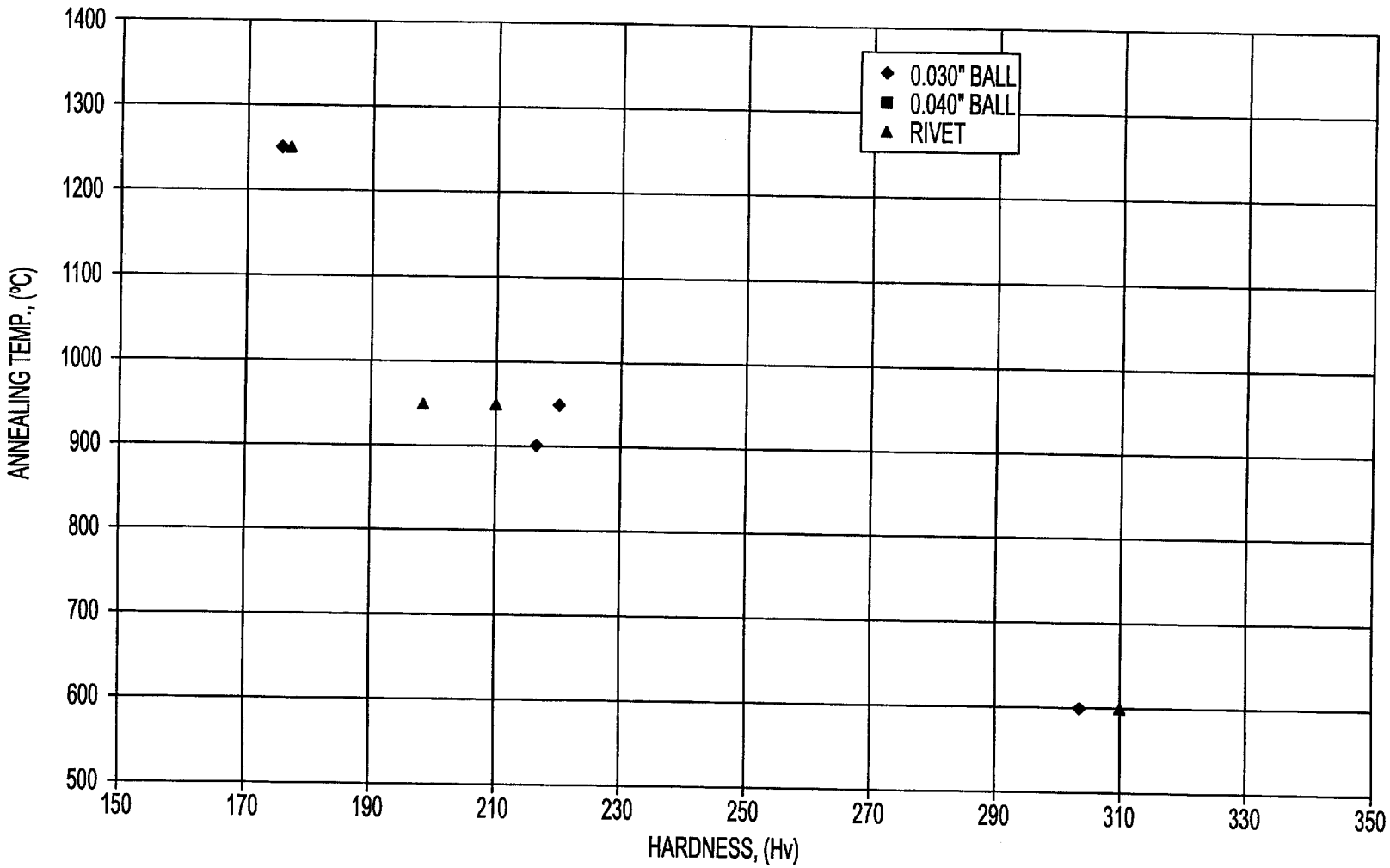
FIG. 10 is a graph indicating the hardness of an annealed 80% Pt—20% Rh alloy after being subjected to an annealing temperature for 5 minutes.

The annealed tip portion 18 exhibits substantially greater resistance to corrosion and erosion over a tip portion that has not been annealed. Referring briefly to FIG. 7, a micrograph illustrates a portion of a platinum-iridium tip portion 18 that has been annealed at 1750° C. for five minutes and at 800° C. for 15 minutes, after same has been subjected to a SPEAD (Spark Plug Electrode Accelerated Durability) test for 75 hours on a dynamometer. The average grain size of annealed 80% Pt—20% Ir is about 250 um in FIG. 7. Severe erosion of the 80% platinum—20% iridium tip along the grain boundaries which has resulted in the loss of the tip material. FIG. 9 shows the hardness of annealed 80% Pt—20% Ir spheres and rivets after being subjected to an annealing temperature for 5 minutes. The hardness of unannealed 80% Pt—20% Ir is about 320–340 Hv. Upon the annealing, the deformed structure will be recrystallized and the hardness will be decreased. The fine grain structure of 80% Pt—20% Ir can be obtained at annealing temperatures ranging from 1200° C. to 1400° C., and produces a hardness of between 260–290 Hv. The coarse grain structure of 80% Pt—20% Ir can be obtained at the annealing temperature of 1700° C., and produces a hardness of between 280 to 300 Hv. The gap growth of a coarse grain 80% Pt—20% Ir tipped spark plug after the SPEAD engine test is about 2.5 times that of a fine grain 80% Pt—20% Ir tipped spark plug. Further improvement of spark erosion resistance can be achieved by the addition of 1 to 4 percent (by weight) of tungsten to platinum-iridium alloy. For example, the gap growth of a fine grain 80% Pt—20% Ir tipped spark plug after a SPEAD engine test is about 3 times that of a fine grain 81% Pt—18% Ir—1% W tipped spark plug. As compared to a coarse grain 80% Pt—20% Ir tipped spark plug, a factor of 7.5 times of spark erosion resistance has been achieved in the fine grain 81% Pt—18% Ir—1% W tipped spark plug.

Figure 8:
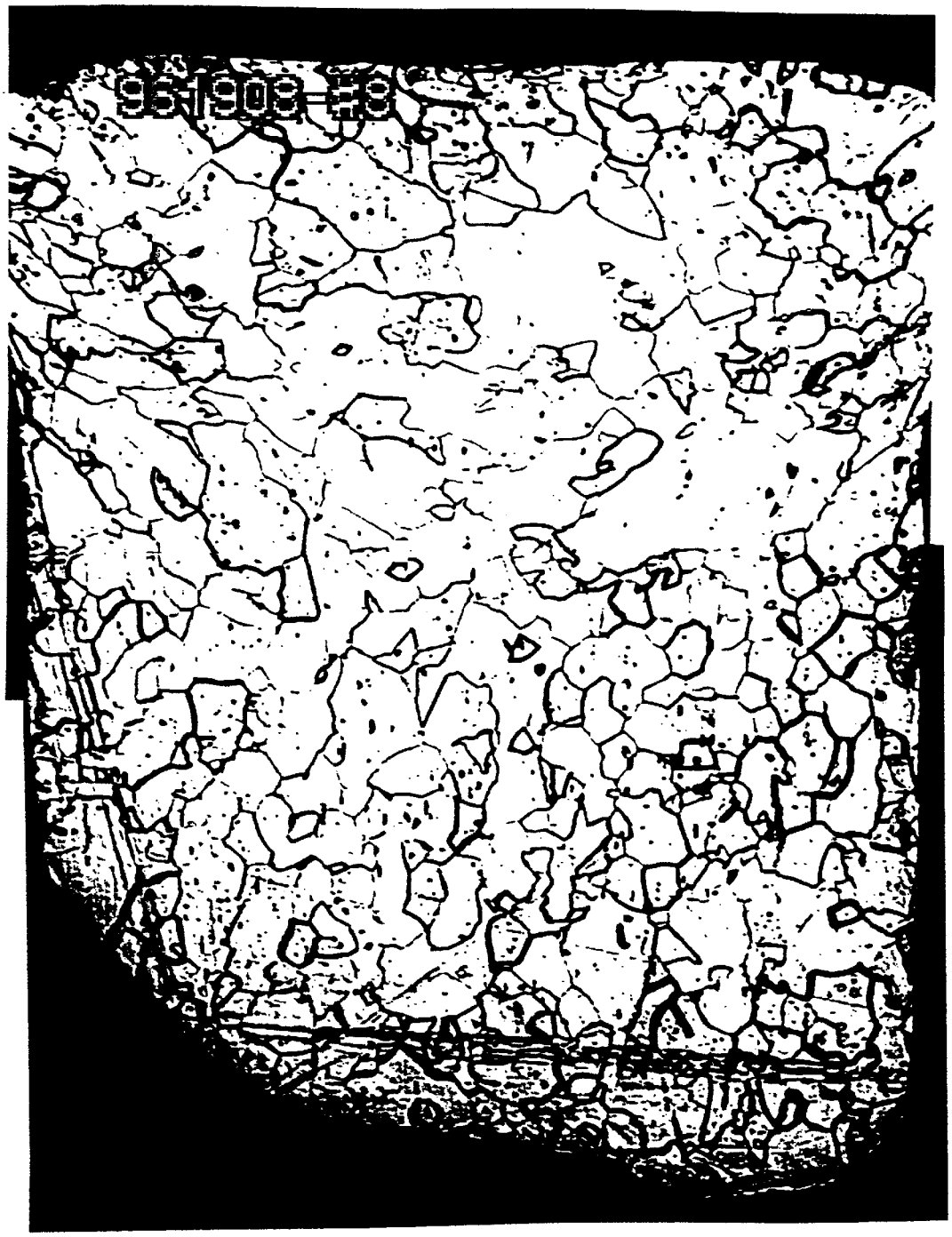
FIG. 8 is a micrograph of a fine grained 80% Pt—20% Rh annealed, platinum based alloy tip portion after same has been exposed for 75 hours to leaded fuel during a SPEAD test.

FIG. 8 is a micrograph of a platinum-rhodium tip portion 18 after same has been subjected to a SPEAD test for 75 hours in leaded fuel. The average grain size of 80% Pt—20% Rh spheres annealed at 950° C. for 15 minutes is about 45 um. The loss of fine grain 80% Pt—20% Rh tip material is small. The hardnesses of unannealed 80% Pt—20% Rh spheres and rivets are about 300–310 Hv. Upon the annealing, the deformed structure will be recrystallized, and the hardness will be decreased. The fine grain structure of 80% Pt—20% Rh can be obtained at annealing temperatures ranging from 800° C. to 1000° C., which produces a hardness of between 200–230 Hv. The coarse grain structure of 80% Pt—20% Rh can be obtained at an annealing temperature of 1250° C., which produces a hardness of between 170 to 180 Hv. The gap growth of a coarse grain 80% Pt—20% Rh tipped spark plug after a SPEAD engine test is about 6.5 times that of a fine grain 80% Pt—20% Rh tipped spark plug.

The method of manufacturing described herein enables platinum alloy tip portions to be constructed which are significantly more resistant to erosion than previously developed tip portions. The annealing performed on the tip portions at the preferred temperature range and preferred time period described herein significantly refines the grain structure, which minimizes the grain boundary erosion and corrosion and significantly increases its resistance to spark erosion in the presence of lead and other corrosive elements. As a result, the gap 24 is substantially maintained over the life of the spark plug.

The tip portion and method of manufacturing same described herein also does not add appreciably to the cost of construction of the spark plug nor necessitate the use of materials that are not already widely commercially available. Accordingly, the spark plug of the present invention can still be manufactured economically and without significant added expense or manufacturing procedures.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification and following claims.

What is claimed is:

1. A method for constructing an electrode for a spark plug using a preformed tip portion, said method comprising the steps of:

first annealing the tip portion at a temperature within a range of approximately 900–1400° C. for a predetermined time period to obtain a fine grain microstructure; and then placing the tip portion in a fixture;

aligning the tip portion with the electrode; and welding the tip portion to the electrode.

2. The method of claim 1, wherein the step of annealing the tip portion for the predetermined time comprises annealing the tip portion for a time between about 5–15 minutes.

3. The method of claim 2, wherein the step of annealing the tip portion comprises placing the tip portion in an annealing furnace containing argon.

4. The method of claim 2, wherein the step of annealing the tip portion comprises placing the tip portion in an annealing furnace containing nitrogen.

5. The method of claim 2, wherein the step of annealing the tip portion comprises placing the tip portion in an annealing furnace subjected to a vacuum.

6. A method for constructing an electrode for a spark plug using a preformed platinum tip portion, said method comprising the steps of:

annealing the tip portion at a temperature within a predetermined temperature range for a time period of between about 5–15 minutes to produce a fine grain microstructure;

allowing the tip portion to cool to a desired temperature;

placing the tip portion in a fixture;

aligning the tip portion with the electrode; and resistance welding the tip portion to the electrode.

7. The method of claim 6, wherein the predetermined temperature comprises a temperature within a range of between about 900–1400° C.

8. The method of claim 6, wherein the step of annealing the tip portion produces a fine grain microstructure equal to or less than about 40 $\mu$m.

9. A spark plug comprising:

an insulator;

a center electrode disposed in part within the insulator;

a ground electrode;

each of the electrodes including a tip portion secured thereto; and wherein each of the tip portions comprise a tip portion annealed to provide a fine grain microstructure of about 40 $\mu$m.

* * * * *